US005383660A

United States Patent [19]

Adler et al.

[11] Patent Number: 5,383,660

[45] Date of Patent: Jan. 24, 1995

[54] FOOTBALL WITH IMPROVED GRIP

[75] Inventors: Alan J. Adler, 752 La Para Ave., Palo Alto, Calif. 94306; Peter S. MacDonald, Menlo Park, Calif.

[73] Assignee: Alan J. Adler, Palo Alto, Calif.

[21] Appl. No.: 6,344

[22] Filed: Jan. 19, 1993

[51] Int. Cl.[6] ..... A63B 41/00

[52] U.S. Cl. ..... 273/65 EG; 273/DIG. 8; 273/DIG. 20

[58] Field of Search ... 273/65 EG, DIG. 8, DIG. 20, 273/65 EE, 65 EF, 65 EC, 65 ED, 65 R; D21/204

[56] References Cited

U.S. PATENT DOCUMENTS

| | | | |
|---|---|---|---|
| 1,543,724 | 6/1925 | Roberts et al. | 273/65 EE |
| 1,559,117 | 10/1925 | Maynard | 273/65 EG |
| 2,011,760 | 8/1935 | Gallinant | 273/65 EG |
| 2,182,053 | 12/1939 | Reach | 273/65 EG |
| 2,653,818 | 9/1953 | Tebbetts et al. | 273/65 EG |
| 3,884,466 | 5/1975 | MacDonald et al. | 273/DIG. 20 |
| 4,772,020 | 9/1988 | Martin | 273/DIG. 20 |
| 4,887,814 | 12/1989 | Winter | 273/65 EG X |
| 4,991,840 | 2/1991 | Patton | 273/65 EE X |
| 5,228,687 | 7/1993 | Luecke et al. | 273/DIG. 20 |
| 5,269,514 | 12/1993 | Adler et al. | 273/65 EE |

*Primary Examiner*—George J. Marlo
*Attorney, Agent, or Firm*—Townsend and Townsend Khourie and Crew

[57] ABSTRACT

A football having a grip configuration which permits the thrower to easily reproduce his optimum hand location with every throw comprises a body with at least one elongated indentation on its surface. The indentation is intersected by a plurality of transverse bulkheads which divide the indentation into a plurality of finger pockets. In specific embodiments, more than four finger pockets are provided to permit an individual thrower to vary his grip location to that which best suits his throw.

19 Claims, 2 Drawing Sheets

FOOTBALL WITH IMPROVED GRIP

BACKGROUND OF THE INVENTION

The present invention relates to balls and more specifically to footballs.

It is well known that a good grip helps one to properly throw a football. It assists in imparting spin and also assists the thrower to accelerate the ball and to accurately direct the path of the throw. Inflated footballs are covered with leather hide which is tied on with a series of laces. To throw, a player grasps the ball with his fingertips on the laces. The laces enhance traction which improves the throw.

In recent years many footballs have been manufactured from soft elastomeric foam materials. Such balls do not have leather covers or laces, nor do they provide the traction afforded by laces. In some balls simulated laces have been molded on the surface of the ball. In practice these simulated laces produce little or no contribution to traction.

Several footballs have been designed with the object of increasing traction. Examples are evidenced in the following U.S. Pat. Nos.: Buckner et al 1,931,429, Riddel 2,194,674, Martin 4,772,020, and Winter 4,887.814. All of these balls have helical ridges and/or grooves. None of these balls permits the user to accurately reproduce (from one throw to the next) the longitudinal location of his grip on the ball.

SUMMARY OF THE INVENTION

The present inventors have discovered that there is an optimum longitudinal location for gripping a football. When the ball is gripped and thrown from this location it is more stable and less likely to wobble in flight than when gripped at other longitudinal locations.

The present invention comprises a football having a grip configuration which permits the thrower to easily reproduce his optimum hand location with every throw. In addition, the grip configuration of the present invention provides superior traction than the grip configurations of prior art footballs.

A football according to the invention comprises a body with at least one elongated indentation array on its surface. The indentation array includes a plurality of indentations. The indentations are separated by a plurality of transverse bulkheads and provide a plurality of finger pockets. The invention provides a grip configuration which permits a thrower to easily reproduce his optimum grip location for every throw.

It has also been discovered that the optimum longitudinal grip location can vary slightly for different throwers. In specific embodiments, more than four finger pockets are provided. This permits an individual thrower to vary his grip location to that which best suits his throw. Once selected, the thrower can easily reproduce that optimum grip location with every throw.

A further understanding of the nature and advantages of the present invention may be realized by reference to the remaining portions of the specification and drawings.

DETAILED DESCRIPTION OF THE SPECIFIC EMBODIMENTS

Figure 1:
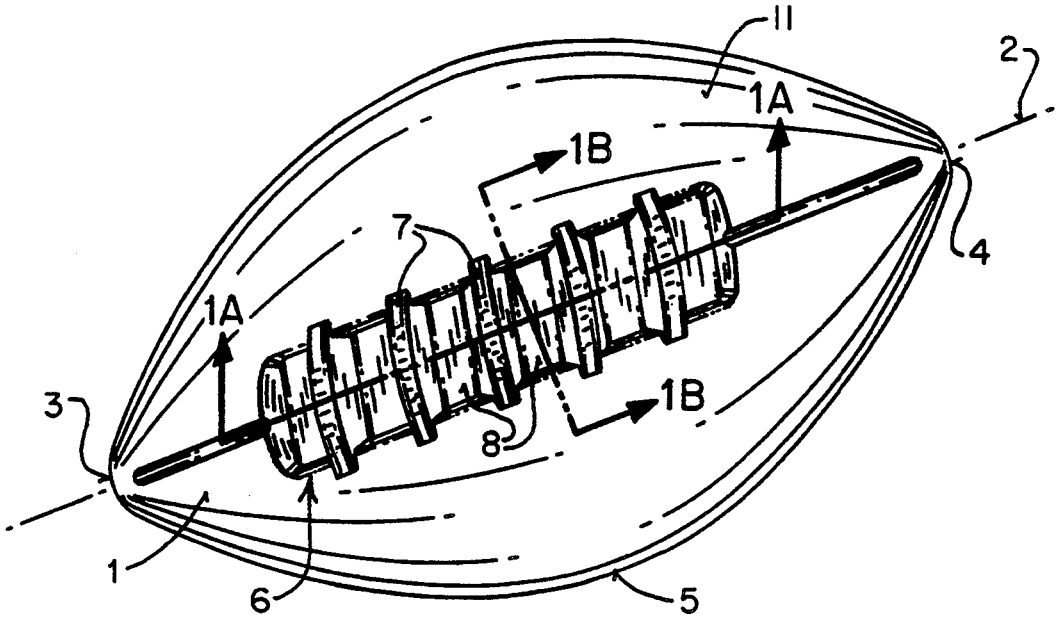
FIG. 1 is a perspective illustration of a football with the grip of the preferred embodiment of the invention.
Figure 1A:
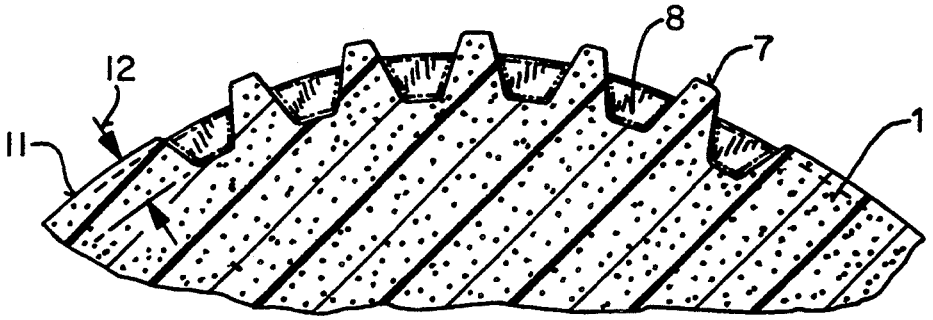
FIG. 1A is a cross-section taken on a longitudinal cut (1A—1A) through the grip region.
Figure 1B:
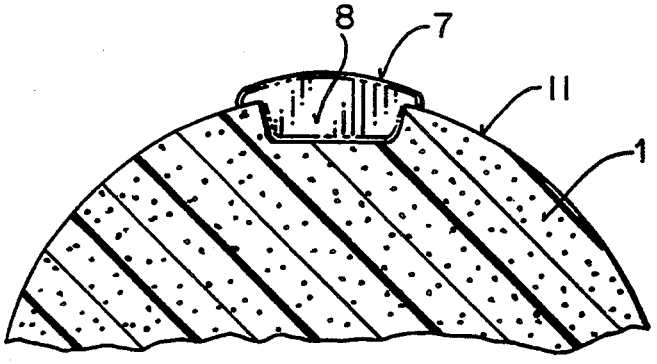
FIG. 1B is a cross-section taken on a transverse cut (1B—1B) through the grip region.

FIG. 1 illustrates a football comprising a body 1 of generally prolate configuration having a longitudinal axis 2 capped by two opposite ends 3 and 4. The body has an outer surface 11 and a maximum diameter 5 midway between the ends. The body is formed with at least one elongated indentation array 6 on surface 11. The indentation array includes a plurality of indentations 8. The long axis of indentation array 6 is oriented generally parallel to the longitudinal axis 2 of the body. The indentation array passes over the maximum diameter 5. A plurality of transverse bulkheads intersecting the long axis of the indentation array separate the indentations, which provide a plurality of finger pockets. The invention is further illustrated in FIG. 1A, which is a cross-section taken on a longitudinal cut (1A—1A) through the grip region, and FIG. 1B, a cross-section taken on a transverse cut (1B—1B) through the grip region. Note in FIG. 1A that the indentations have a depth 12 below surface 11 of body 1.

Figure 2:
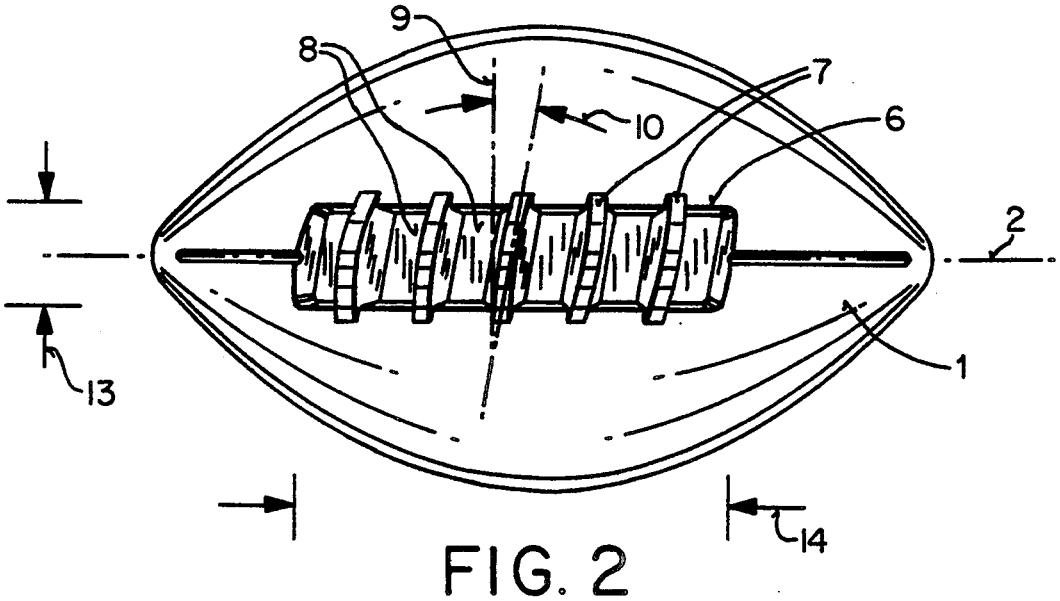
FIG. 2 is a plan view of the football illustrating the parallelogram planform of the indentation and the angled orientation of the bulkheads of the preferred embodiment of the invention.

FIG. 2 is a plan view of the preferred embodiment of the invention. Note that the perimeter of indentation array 6 is substantially a non-rectangular parallelogram. Further note that transverse bulkheads 7 are oriented at an angle 10 from a perpendicular 9 drawn to longitudinal axis 2. This results in non-rectangular parallelogram-shaped indentations. In the preferred embodiment, angle 10 is between five and twenty-five degrees (5°–25°). This angle provides a right-handed thrower with an optimum hand position. The indentation array is characterized by a width 13 and a length 14.

Figure 3:
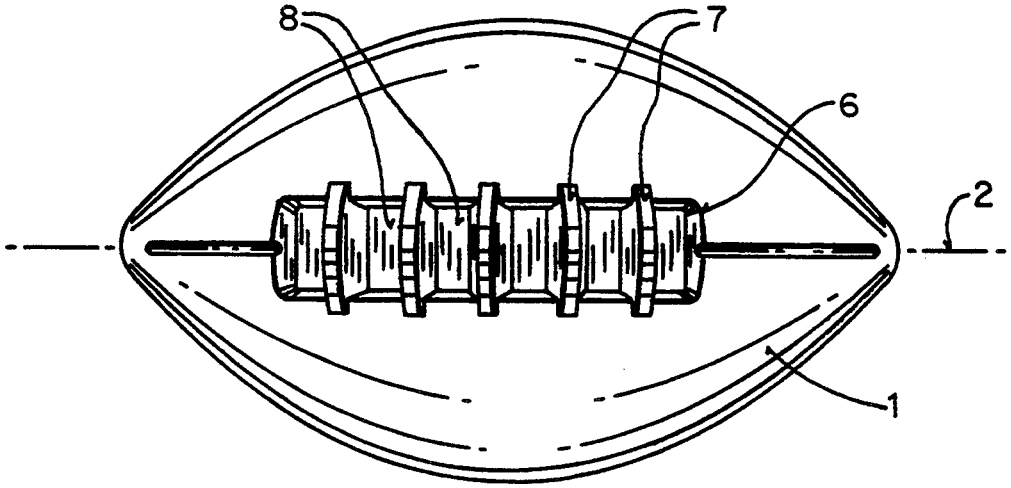
FIG. 3 is an alternative embodiment of the invention with the transverse bulkheads perpendicular to the longitudinal axis.

FIG. 3 illustrates an alternative embodiment of the invention. In this embodiment, indentation array 6 is of substantially rectangular perimeter and transverse bulkheads 7 are substantially perpendicular to longitudinal axis 2. This configuration has the advantage that it is suitable for right-handed and left-handed throwers.

Figure 4:
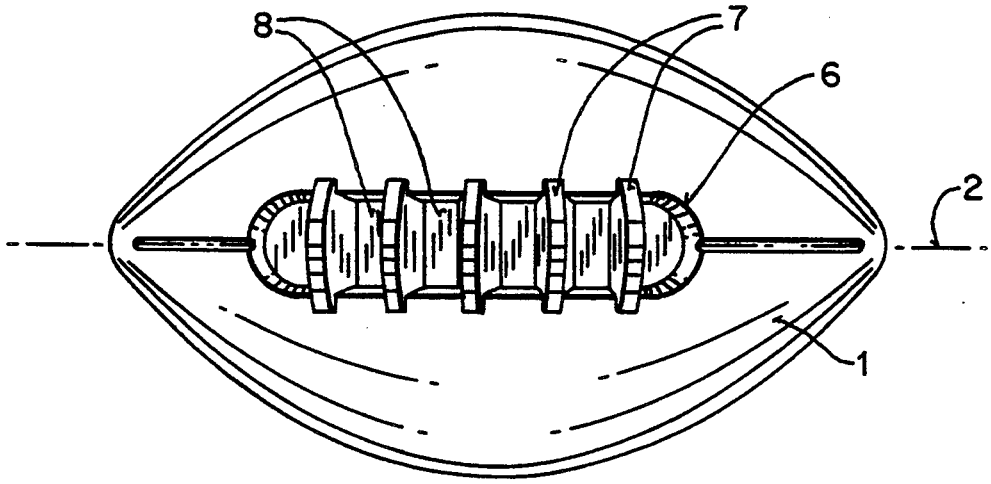
FIG. 4 is an alternative embodiment of the invention with a grip indentation of substantially oval planform.

FIG. 4 illustrates another alternative embodiment of the invention wherein indentation array 6 is of substantially oval planform. In this figure transverse bulkheads 7 are depicted perpendicular to longitudinal axis 2; however, they may also be angled as illustrated in FIG. 2. This results in the indentations at the end of the indentation array being generally semicircular and the indentations intermediate and indentations at the ends of the array being parallelogram-shaped (rectangular in the figure).

To properly fit the hand, the preferred length of indentation array 6 is between four and six inches (4–6 in.) and the preferred width of indentation array 6 is between one and two inches (1–2 in.). The preferred depth of the indentations is between one-tenth inch and one inch (0.1–1.0 in.) below outer surface 11 of the body. As can be seen from the figures, the indentations have transverse dimensions that are greater than their longitudinal dimensions.

Although only three transverse bulkheads 7 are essential to create four finger pockets 8, it is desirable to have extra bulkheads to create additional finger pockets which permit the thrower to vary his grid location to that which best suits his throw. Once selected, the thrower can easily reproduce that optimum grip location for every throw. This also allows the thrower to spread his fingers over more than four pockets if desired.

By way of example, the invention may be implemented as a small football with a longitudinal axis of approximately 8.5 inches and a maximum diameter of approximately 5 inches with six pockets and a bulkhead spacing of about 7/8 inches. A larger ball would typically have comparably-sized or slightly larger finger pockets, and could also have more finger pockets. A smaller ball would typically have comparably-sized or slightly smaller finger pockets and could also have fewer finger pockets.

While the foregoing specification describes the invention in detail in order to make a full disclosure, it will be understood that variations or modifications are possible. For example, the novel grip of the present invention is illustrated in the context of an otherwise standard foam football. There is, however, no reason that other enhancements could not be incorporated. For example, various fin arrangements have been proposed to improve the flight characteristics of the thrown football, and the present invention can be embodied in a football with other such enhancements. Therefore, the above description should be not be taken as limiting the scope of the invention which is defined by the claims.

What is claimed is:

1. In a football having a body of generally prolate configuration having an outer surface, a longitudinal axis capped by two opposite ends, and a maximum diameter midway between said ends, the improvement wherein:

said outer surface of said body is formed with at least one indentation array, said indentation array having a long axis oriented generally parallel to the longitudinal axis of said body, said indentation array passing over said maximum diameter;

said indentation array includes a plurality of N indentations spaced along said long axis, including a pair of indentations at opposite ends of said indentation array and a plurality of intermediate indentations therebetween;

each of said indentations extends below said outer surface of said body by a respective depth; each of said intermediate indentations is separated from two neighboring indentations by respective portions of said body, which portions together define a plurality of (N−1) bulkheads;

said bulkheads are parallel to each other and extend in a transverse direction that is generally perpendicular to said long axis;

said intermediate indentations are generally rectangular;

said indentations and said bulkheads have longitudinal dimensions along said long axis and transverse dimensions along a direction perpendicular to said long axis;

said transverse dimensions of said intermediate indentations are greater than said longitudinal dimensions of said indentations, but less than said maximum diameter;

said longitudinal dimensions of said bulkheads are smaller than said longitudinal dimensions of said intermediate indentations; and said longitudinal and transverse dimensions of said indentations, said transverse dimensions of said bulkheads, and said depths of said indentations are such that said indentations provide finger pockets that facilitate a user gripping the football for throwing same.

2. The improvement of claim 1 wherein:

said pair of indentations at opposite ends of said indentation array are generally rectangular; and said indentation array has a generally rectangular perimeter.

3. The improvement of claim 1 wherein:

said pair of indentations at opposite ends of said indentation array are generally semicircular; and said indentation array has a generally oval perimeter.

4. The improvement of claim 1 wherein said indentation array is between four inches and six inches long.

5. The improvement of claim 1 wherein said indentation array is between one inch and two inches wide.

6. The improvement of claim 1 wherein said indentations have respective depths below said outer surface of said body of between one-tenth inch and one inch.

7. The improvement of claim 1 wherein:

said indentation array is between four inches and six inches long;

said indentation array is between one inch and two inches wide; and said indentations have respective depths below said outer surface of said body of between one-tenth inch and one inch.

8. The improvement of claim 1 wherein at least some of said bulkheads have a dimension perpendicular to said longitudinal axis of said body that exceeds said depth of said indentations so that said at least some of said bulkheads extend outwardly above said outer surface.

9. The improvement of claim 1 wherein said body and said bulkheads are formed from elastomeric foam.

10. In a football having a body of generally prolate configuration having an outer surface, a longitudinal axis capped by two opposite ends, and a maximum diameter midway between said ends, the improvement wherein:

said outer surface of said body is formed with at least one indentation array, said indentation array having a long axis oriented generally parallel to the longitudinal axis of said body, said indentation array passing over said maximum diameter;

said indentation array includes a plurality of N indentations spaced along said long axis, including a pair of indentations at opposite ends of said indentation array and a plurality of intermediate indentations therebetween;

each of said indentations extends below said outer surface of said body by a respective depth;

each of said intermediate indentations is separated from two neighboring indentations by respective portions of said body, which portions together define a plurality of (N−1) bulkheads;

said bulkheads are parallel to each other and extend in a transverse direction at an acute angle from a direction perpendicular to said long axis;

said intermediate indentations are generally parallelogram-shaped;

said indentations and said bulkheads have longitudinal dimensions along said long axis and transverse dimensions along a direction perpendicular to said long axis;

said transverse dimensions of said intermediate indentations are greater than said longitudinal dimensions of said indentations, but less than said maximum diameter;

said longitudinal dimensions of said bulkheads are smaller than said longitudinal dimensions of said intermediate indentations; and said longitudinal and transverse dimensions of said indentations, said transverse dimensions of said bulkheads, and said depths of said indentations are such that said indentations provide finger pockets that facilitate a user gripping the football for throwing same.

11. The improvement of claim 10 wherein:

said pair of indentations at opposite ends of :said indentation array are generally parallelogram-shaped; and said indentation array has a generally parallelogram-shaped perimeter.

12. The improvement of claim 10 wherein said transverse bulkheads are oriented at an angle of between five degrees and twenty-five degrees from a perpendicular drawn to said long axis.

13. The improvement of claim 10 wherein said indentation array is between four inches and six inches long.

14. The improvement of claim 10 wherein said indentation array is between one inch and two inches wide.

15. The improvement of claim 10 wherein said indentations have respective depths below said outer surface of said body of between one-tenth inch and one inch.

16. The improvement of claim 10 wherein:

said indentation array is between four inches and six inches long;

said indentation array is between one inch and two inches wide; and said indentations have respective depths below said outer surface of said body of between one-tenth inch and one inch.

17. The improvement of claim 10 wherein at least some of said bulkheads have a dimension perpendicular to said longitudinal axis of said body that exceeds said depth of said indentations so that said at least some of said bulkheads extend outwardly above said outer surface.

18. The improvement of claim 10 wherein said body and said bulkheads are formed from elastomeric foam.

19. In a football having a body of generally prolate configuration having an outer surface, a longitudinal axis capped by two opposite ends, and a maximum diameter midway between said ends, the improvement wherein:

said outer surface of said body is formed with at least one indentation array, said indentation array having a long axis oriented generally parallel to the longitudinal axis of said body, said indentation array passing over said maximum diameter;

said indentation array includes a plurality of N indentations spaced along said long axis, including a pair of indentations at opposite ends of said indentation array and a plurality of intermediate indentations therebetween;

each of said indentations extends below said outer surface of said body by a respective depth;

each of said intermediate indentations is separated from two neighboring indentations by respective portions of said body, which portions together define a plurality of (N−1) bulkheads;

said bulkheads are parallel to each other and extend in a transverse direction relative to said long axis;

said intermediate indentations are generally parallelogram-shaped;

said indentations and said bulkheads have longitudinal dimensions along said long axis and transverse dimensions along a direction perpendicular to said long axis;

said transverse dimensions of said intermediate indentations are greater than said longitudinal dimensions of said indentations, but less than said maximum diameter;

said longitudinal dimensions of said bulkheads are smaller than said longitudinal dimensions of said intermediate indentations; and said longitudinal and transverse dimensions of said indentations, said transverse dimensions of said bulkheads, and said depths of said indentations are such that said indentations provide finger pockets that facilitate a user gripping the football for throwing same.

* * * * *